United States Patent [19]

Griffing et al.

[11] Patent Number: 4,852,860

[45] Date of Patent: Aug. 1, 1989

[54] CONSUMABLE INJECTION LANCE

[75] Inventors: Neal R. Griffing, Bethlehem; Evan L. Hand, Sr., Hummelstown, both of Pa.

[73] Assignee: Bethlehem Steel Corporation, Bethlehem, Pa.

[21] Appl. No.: 288,665

[22] Filed: Dec. 19, 1988

Related U.S. Application Data

[63] Continuation-in-part of Ser. No. 88,449, Aug. 24, 1987, Pat. No. 4,792,125.

[51] Int. Cl.[4] ..... C21C 5/32

[52] U.S. Cl. ..... 266/268; 266/225; 266/270

[58] Field of Search ..... 266/225, 266, 267, 268, 266/270

[56] References Cited

U.S. PATENT DOCUMENTS

| | | | |
|---|---|---|---|
| 3,976,286 | 8/1976 | Thompson et al. | 266/225 |
| 4,084,800 | 4/1978 | Butts et al. | 266/225 |
| 4,550,898 | 11/1985 | LaBate, II | 266/225 |
| 4,779,847 | 10/1988 | Rodway | 266/270 |
| 4,783,058 | 11/1988 | Perri | 266/266 |
| 4,792,125 | 12/1988 | Hand, Sr. | 266/225 |

FOREIGN PATENT DOCUMENTS

| | | | |
|---|---|---|---|
| 3131793 | 2/1983 | Fed. Rep. of Germany | 266/225 |
| 2123535 | 2/1984 | United Kingdom | 266/225 |

*Primary Examiner*—Robert McDowell
*Attorney, Agent, or Firm*—John I. Iverson

[57] ABSTRACT

A consumable lance for injecting oxygen and other gases such as argon below the surface of a molten metal bath the lance comprising an upper manifold portion, a lower nozzle end portion, and a plurality of gas conveying conduits attached to a structural support assembly and encased within a protective refractory covering.

11 Claims, 3 Drawing Sheets

OXYGEN 19
10
INERT GAS
12
22
29
18
2
2
23
24
20
21
30
11
3
3
26
26
15
16
16
25
25
17
4
4
27

27
16
16
25
25
17
26
26
13
15
29
27
14

CONSUMABLE INJECTION LANCE

RELATED PRIOR APPLICATIONS

This application is a continuation-in-part of application serial no. 088,449 filed Aug. 24, 1987 and granted U.S. Pat. No. 4,792,125 on Dec. 20, 1988.

BACKGROUND OF THE INVENTION

This invention relates to consumable lance devices for introducing oxygen or other gases such as argon below the surface of a molten metal bath. It relates specifically to consumable lance devices for injecting oxygen below the surface of a molten metal bath to raise the temperature of the bath prior to continuous casting or pouring into teeming ingots.

At present, consumable lance devices include straight longitudinal conduits for injecting gases below the surface of a molten metal bath. However, the present invention is directed to the selection of the number, size and arrangement of such straight longitudinal conduits to maximize lance life in consumable lances having varying dimensions and oxygen flow rates.

SUMMARY OF THE INVENTION

It is therefore an object of this invention to provide a consumable lance having improved wear resistance.

It is a further object of this invention to provide such improved wear resistance through the selection and arrangement of the oxygen conveying conduits.

It is still a further object of this invention to provide a consumable lance having a supporting structure to maintain a critical spaced relationship between oxygen conveying conduits.

It is still a further object of this invention to provide gas conveying means for injecting inert gases below the surface of a molten metal bath.

I have discovered that the foregoing objects can be attained with a consumable lance comprising an upper lance portion including a gas disbursing manifold, a lower lance portion including a nozzle end for injecting oxygen into a molten metal bath, a structural support assembly extending downwardly from the upper lance portion to the nozzle end of the lower lance portion and provided with a plurality of anchor brackets and spacers alternately spaced along the length of the structural support assembly, one or more sets of concentrically spaced longitudinal oxygen conveying conduits also extending downwardly from the upper lance portion to the nozzle end of the lower lance portion the oxygen conveying conduits being maintained in a critical spaced relationship by the spacers of the structural support assembly, one or more longitudinal inert gas conveying conduits extending along the central core of the structural support assembly to the nozzle end of the lower lance portion, and a protective refractory covering extending from the upper lance portion to the nozzle end of the lower lance portion and completely surrounding and encasing the structural support assembly, each oxygen conveying conduit and each inert gas conduit.

DETAILED DESCRIPTION OF THE PREFERRED EMBODIMENT

It has been found that the wear rate of consumable lances, having straight longitudinal gas conveying conduit tubes, decreases as the oxygen flow rate decreases in each oxygen conveying conduit tube housed within such lances. It then follows, that if a total required oxygen flow rate is desired, lance life can be increased by simply adding more and more oxygen conveying conduit tubes to reduce the oxygen flow rate per tube. Such a statement is true up to a practical limit, for when the spacing between the oxygen conduit tubes becomes too small interaction among the adjacent oxygen conduits will begin to occur and such interaction will contribute to lance wear.

It has also been found that when the relatively cool oxygen, being injected into the molten metal bath, flows through the tubes it creates a heat sink effect and the oxygen cools the tubes and surrounding refractory covering. However, we have discovered that when the spacing between the oxygen conduit tubes becomes too small due to increasing the number of oxygen tubes to decrease the oxygen flow rate per tube, the heat sink effect of the oxygen is either reduced or lost causing interaction between the tubes at the nozzle end of the consumable lance and overheating and failure of the surrounding protective refractory covering. We have also discovered that this same heat sink effect applies to the edge distance from the outermost oxygen conduit tubes to the periphery of the protective refractory covering. This outside edge distance is the first line of defense against lance failure due to the temperatures of the hostile environment of the molten metal bath. If this edge distance becomes either too small or too large, the heat sink effect of the oxygen flowing through the conduits is reduced or lost causing refractory failure and reduced lance life.

Therefore, in order to achieve maximum lance life, it is critical that the greatest number of oxygen conduit tubes be arranged in a pattern which will not exceed a critical tube to tube spacing or tube to edge distance spacing.

Figure 1A:
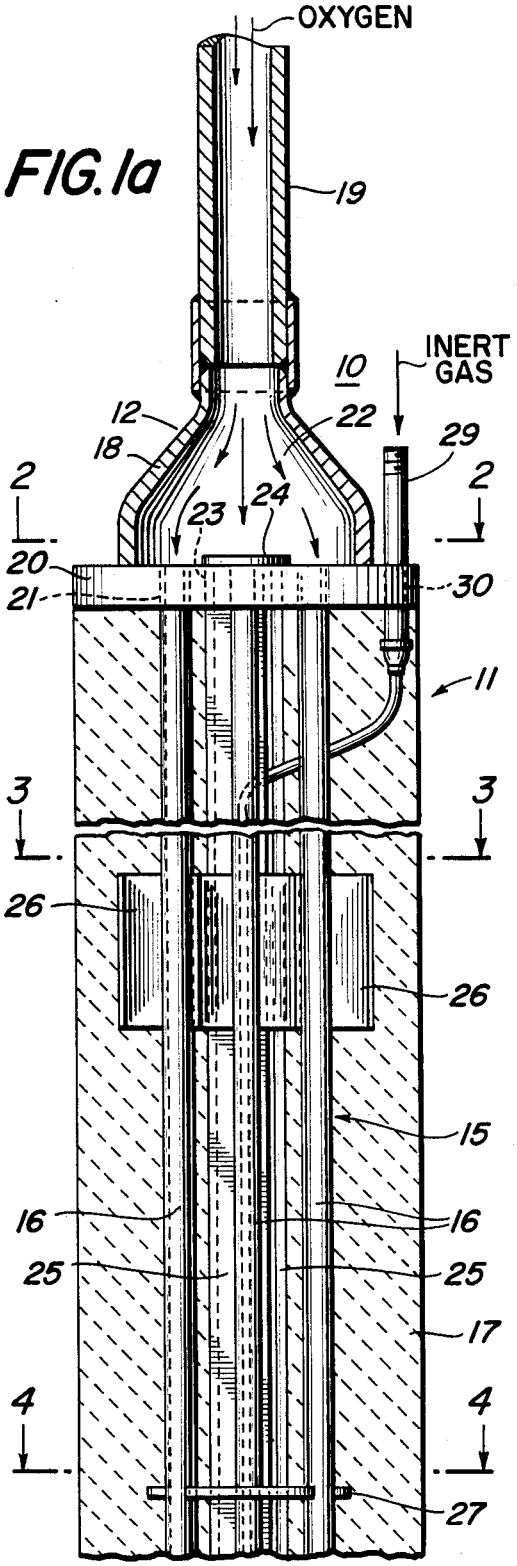
FIG. 1*a* is an elevational view in partial cross-section showing the upper end portion of the lance of the present invention.
Figure 1B:
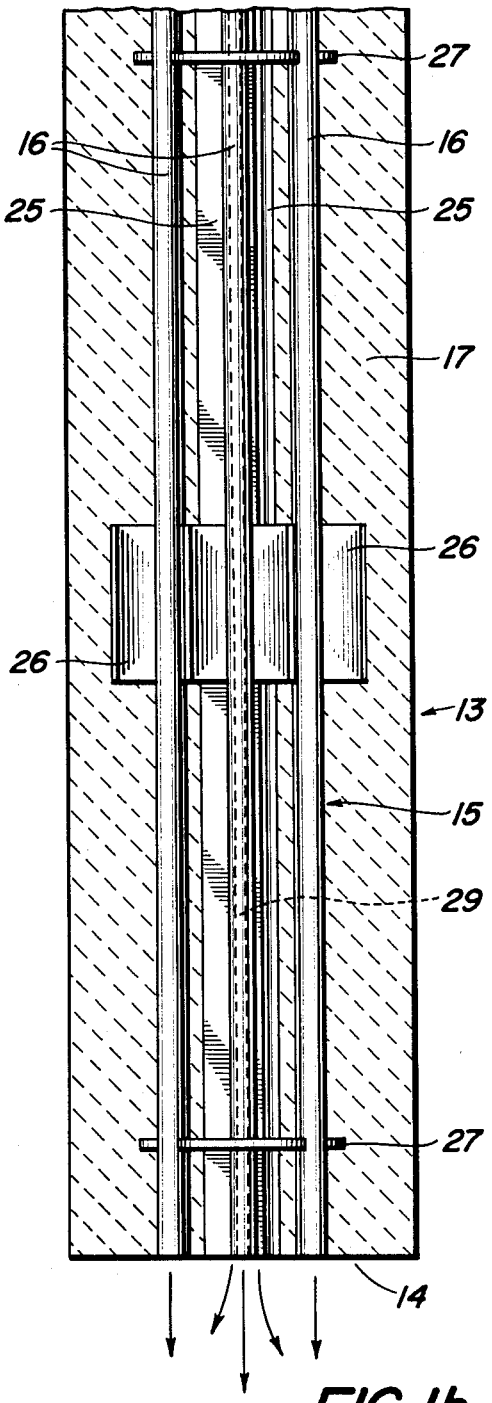
FIG. 1*b* is an elevational view in partial cross-section showing the lower end portion of the lance of the present invention.

Referring to FIGS. 1*a* and 1*b* of the drawings, a consumable lance 10 of the present invention comprises an upper lance portion 11 including an oxygen distribution manifold 12, a lower lance portion 13 including a nozzle end 14 for injecting gases into the molten metal bath, a longitudinal structural support assembly 15 extending between the manifold 12 and nozzle end 14, a plurality of longitudinal oxygen conveying conduits or tubes 16 also extending between the manifold 12 and nozzle end 14, inert gas conveying conduits 29 extending along the central core of the structural support assembly 15, and, a refractory convering 17 encasing the structural support assembly 15, each oxygen conveying conduit 16 and each inert gas conveying conduit 29 within a protective refractory shield.

Figure 2:
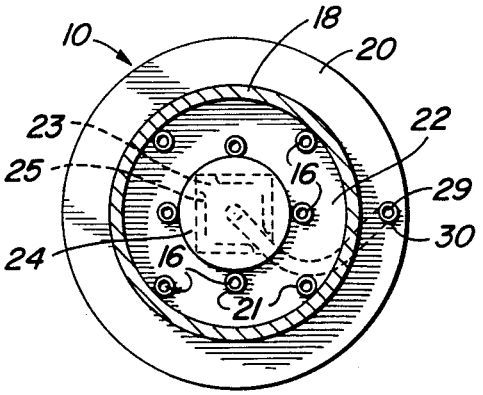
FIG. 2 is a cross-sectional view of the lance manifold taken along the lines 2—2 of FIG. 1*a;*

As shown in FIGS. 1*a* and 2, the oxygen distribution manifold 12, located in the upper lance portion 11, includes a bell shaped housing 18 having an oxygen supply line 19 attached to its upper, smaller end and a manifold cover plate 20 attached to its lower, larger end. The manifold cover plate 20 is provided with a plurality of openings 21 corresponding to each oxygen conduit 16 to allow the oxygen conduits 16 access to manifold chamber 22. Opening 23, located along the longitudinal center line of lance 10, provides means for attaching the structural support assembly 15 to the manifold cover plate 20 and a gas tight seal 24, located within manifold chamber 22, effectively seals opening 23 to prevent leakage of oxygen along the length of the support assembly 15.

The structural support assembly 15 extends downwardly from the underside of the manifold cover plate 20 to the nozzle end 14 along the central axis of the consumable lance 10 and comprises elongated support members 25, "V" shaped anchor brackets 26 and spacers 27. Anchor brackets 26 and spacers 27 are alternatively spaced along the length of the structural support assembly 15 and are attached thereto by welding or soldering. Each spacer is provided with openings 28 to permit passage of the oxygen conveying conduits 16 through the spacers 27.

Figure 3:
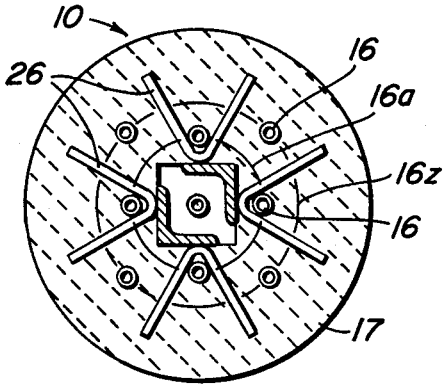
FIG. 3 is a cross-sectional view of the lance taken along the lines 3—3 of FIG. 1*a* showing the anchor bracket means of the structural assembly.
Figure 4:
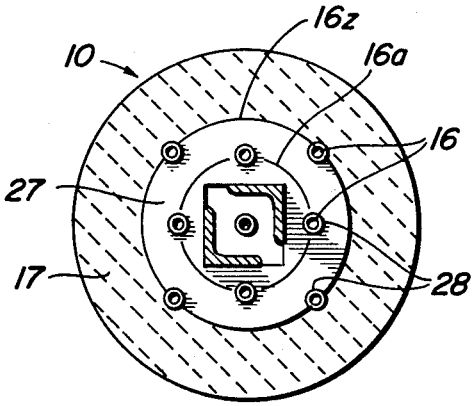
FIG. 4 is a cross-sectional view of the lance taken along the lines 4—4 of FIG. 1*a* showing the spacer means of the structural assembly and critical arrangement of the oxygen conveying conduits.

One or more sets of oxygen conveying conduits or tubes 16 are concentrically spaced about the longitudinal axis of the lance 10 and extend from the manifold chamber 22 to the nozzle end 14. The first set of oxygen conveying conduits are radially spaced along a first concentric tube circle 16*a*, as shown in FIGS. 2, 3 and 4, and extend from manifold chamber 22 to nozzle end 14. Each oxygen conveying conduit 16 of set 16*a* is retained within corresponding openings 28 in spacers 27 to maintain its critical spaced relationship to the other oxygen conveying conduits 16.

A second set of oxygen conveying conduits are radially spaced along a second concentric tube circle 16*z* and extend from the manifold chamber 22 to the nozzle end 14 and each gas conveying conduit 16 of set 16*z* is attached to the periphery of each spacer 27 located along the length of lance 10 to maintain its critical spaced relationship to the other oxygen conveying conduits 16.

One or more inert gas conveying conduits 29 may be provided within the lance 10 for injecting gases such as argon below the surface of the molten metal bath. Such inert gas conduits 29 extend through openings 30 provided in manifold cover plate 20 and extend along the central core of the structural support assembly 15 to the nozzle end 14 of the lance 10.

A protective refractory covering 17 extends from the underside of the manifold cover plate 20 to the nozzle end 14 of lance 10 and is bonded to the "V" shaped anchor brackets 26 which are attached to the structural support assembly 15. The protective refractory covering 17 completely encases the structural support assembly 15, each oxygen conveying conduit 16 and each inert gas conveying conduit 29.

Figure 5:
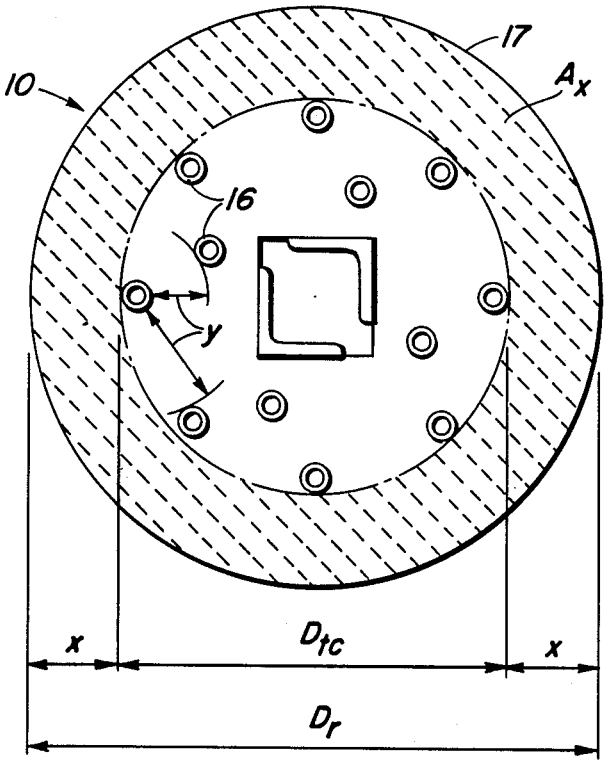
FIG. 5 is a cross-sectional view of any consumable lance having straight longitudinal gas conveying conduits showing the critical spaced relationships between the various components of such lances.

Referring to FIG. 5 of the drawings, a consumable lance 10, having the outside diameter of its protective refractory covering 17 defined as "$D_r$", is shown having oxygen conveying conduit tubes 16 arranged within a tube circle diameter "$D_{tc}$". Tubes 16 are arranged within "$D_{tc}$" to maintain a tube to tube spaced relationship "y" and an edge distance of "x" from the outermost tubes 16 within "$D_{tc}$" to the periphery of the protective refractory covering 17. Edge distance "x" defines a circumferential conduit free area "$A_x$" which encircles the oxygen conveying conduits 16 falling within the "$D_{tc}$" of the consumable lance.

In practice it has been found that a practical "$D_r$" is from 6" to 10" in diameter. A lance having less than a 6" outside diameter tends to bend during use and lances having outside diameters of greater than 10" become excessively heavy. Given this "$D_r$" range, the total number of oxygen conduits 16 required to bring a molten metal bath up to casting temperatures, and at the same time maximize lance life, can be determined by a tube quantity to total lance cross-sectional area ratio in the range of 0.08 to 0.22. For example, using this ratio, a 10" diameter consumable lance would house 6 to 17 oxygen conveying conduit tubes within "$D_{tc}$". A 6" diameter consumable lance, on the other hand, would house only 2 to 6 such oxygen conveying conduit tubes within "$D_{tc}$". The conduits 16 in FIG. 5 are shown arranged in a concentric fashion, however, the oxygen conduits may be arranged in any orderly fashion within "$D_{tc}$" as long as the tube to tube spacing "y" is $\geqq 1''$ and as long as "x" is $\geqq 1''$ but $\leqq 2''$ and "$A_x$" is in the range of 50% to 75% of the total lance cross-sectional area.

Given such geometric constraints, the required number of oxygen conveying conduit tubes for a lance having an outside diameter "$D_r$ is determined from the relationship between an oxygen flow rate per tube which is consistent with long lance life, and the total oxygen flow required for a particular heat size. We have found that long lance life is experienced when the oxygen flow rate per tube is $\leqq 400$ SCFM is set forth in the following table "A".

TABLE A

| Oxygen Per Tube SCFM | Lance Wear Inch/Min. |
|---|---|
| 400 | 6.1 |
| 300 | 4.8 |
| 200 | 3.5 |
| 100 | 2.2 |

We have also found that the total oxygen flow required for raising the temperature of a heat at a rate of 10 F./min. as described in our earlier patent U.S. Pat. No. 4,461,178 to Griffing, is dependent upon the heat size as set forth in the following table "B".

TABLE B

| Heat Size NT | Total Oxygen SCFM |
|---|---|
| 100 | 600 |
| 150 | 900 |
| 200 | 1200 |
| 250 | 1500 |
| 300 | 1800 |
| 350 | 2100 |
| 400 | 2400 |

Such oxygen flow rates, as shown in table "B", can vary somewhat depending upon specific situations such as type of steel and the desired rate of temperature increase.

Given the total oxygen flow information and the geometric limits of the lance, a total number of oxygen conduit tubes to achieve maximum lance life can be determined. For example, in a consumable lance having a "$D_r$" of 10" and a total oxygen flow of 1800 SCFM for a 300 NT heat, 12 oxygen conveying tubes, the midrange of the tubes allowed within the geometry of such a 10" lance, would deliver oxygen to the nozzle end of the lance at an oxygen flow rate of 150 SCFM per tube. Such an oxygen flow rate per tube would produce a lance wear rate of 2.9 inch/min. However, in a consumable lance having a "$D_r$" of only 6", a midrange choice of 4 tubes would deliver oxygen to the nozzle end of the lance at an oxygen flow rate of 450 SCFM per tube and produce an unsatisfactory lance wear rate of greater than 6.1 inch/min. Using the maximum number of 6 oxygen conveying tubes for such a 6" lance, oxygen would be delivered to the nozzle end of the lance at a flow rate of 300 SCFM resulting in an acceptable lance wear rate of 4.8 inch/min.

Although only one embodiment of the present invention has been illustrated and described, it will be apparent to those skilled in the art that various changes and modifications may be made therein without departing from the spirit of the invention.

I claim:

1. A consumable lance for injecting gases below the surface of a molten metal bath said consumable lance comprising:

(a) an upper lance portion including a gas disbursing manifold attached to a gas source.

(b) a lower lance portion including a nozzle end for injecting said gases into the molten metal bath.

(c) a longitudinal structural support assembly extending from said gas disbursing manifold to said nozzle end said longitudinal structural support assembly including:

(i) elongated support members extending downwardly along the central axis of the consumable lance from the gas disbursing manifold to said nozzle end and secured within an opening provided within the manifold cover plate of said gas disbursing manifold, and, (ii) anchor members and spacer members alternatively spaced along the length of said elongated support members where said anchor members are attached to said elongated support members and the spacer members enclose said elongated structural support members and are provided with concentrically spaced sets of openings;

(d) longitudinal gas conveying conduits extending from a manifold chamber within said gas disbursing manifold to said nozzle end and said gas conveying conduit tubes confined within the concentrically spaced sets of openings of said spacer members of the structural support assembly (c) to maintain a tube to tube spaced relationship, and, (e) a protective refractory covering surrounding and encasing said longitudinal structural support assembly and each said longitudinal gas conveying conduit said protective covering extending from the underside of said gas disbursing manifold to said nozzle end.

2. The consumable lance according to claim 1 wherein one or more gas conveying conduits are attached to a second gas source said gas conveying conduits located outside the manifold chamber of said gas disbursing manifold and extending downward along the central core of said longitudinal structural support assembly (c) to the nozzle end of the lower lance portion (b) said second gas source conduits being encased within the protective refractory convering (e).

3. The consumable lance according to claim 1 wherein the opening provided within said manifold cover plate for securing said longitudinal structural assembly (c) is provided with a gas tight seal to prevent gases from escaping from the manifold chamber into the central core of said longitudinal structural support assembly.

4. The consumable lance according to claim 1 wherein the longitudinal gas conduits (c) comprise:

(a) a first concentric set of tubes spaced about the central longitudinal axis of the consumable lance said first set of tubes spaced along a tube circle and extending from a manifold chamber within said gas disbursing manifold of said upper lance portion (a) through corresponding openings of a first set of concentrically spaced sets of openings within said spacer members of said structural support assembly (c) and said tubes continuing thereon to the nozzle end of said lower lance portion (b), and, (b) a last concentric set of tubes spaced about the central longitudinal axis of the consumable lance said last set of tubes spaced along a tube circle and extending from said manifold chamber of the gas disbursing manifold through corresponding openings of a last set of concentrically spaced sets of openings within said spacer members said last set of concentrically spaced openings spaced along the periphery of said spacer members and said tubes continuing thereon to the nozzle end of said lower lance portion (b).

5. The consumable lance according to claim 4 wherein the longitudinal gas conveying conduit tubes have a tube to tube spacing of "y"$\geqq$1".

6. A consumable lance for injecting gases below the surface of a molten metal bath said consumable lance comprising an upper lance portion including a gas disbursing manifold attached to a gas source, a lower lance portion including a nozzle end for injecting said gases into the molten metal bath, a longitudinal structural support assembly extending from said upper lance portion to the nozzle end of said lower lance portion, longitudinal gas conveying conduit tubes spaced about said longitudinal structural support assembly and extending from a manifold chamber within the gas disbursing manifold of said upper lance portion to the nozzle end in said lower lance portion, and a protective refractory covering surrounding and encasing said longitudinal structural support assembly and each said longitudinal gas conveying conduit, said protective covering extending from said upper lance portion to the nozzle end of said lower lance portion wherein:

(a) The total number of said longitudinal gas conveying conduit tubes are arranged within a tube circle diameter "$D_{tc}$" and where the total number of said tubes within said "$D_{tc}$" is in the range of 0.8 to 0.22 times the total cross-sectional area of said consumable lance, (b) the tube to tube spacing "y" of said gas conveying conduit tubes within said "$D_{tc}$" is $\geqq$1", (c) the edge distance "x" is $\geqq$1" but $\leqq$2", and (d) The cross-sectional edge distance area "$A_x$" is 50% to 75% of the total cross-sectional area of the consumable lance.

7. The consumable lance according to claim 6 wherein the gas conveying tubes (b) are capable of delivering oxygen to the nozzle end of the consumable lance at a flow rate of ≦400 SCFM.

8. The consumable lance according to claim 6 wherein the structural assembly comprises:

(a) elongated support members extending downwardly along the central axis of the consumable lance from the gas disbursing manifold to said nozzle end and secured within an opening provided within the manifold cover plate of said gas disbursing manifold, and, (b) anchor members and spacer members alternately spaced along the length of said elongated support members where said anchor members are attached to the said elongated support members and the spacer members enclose said elongated structural support members and are provided with concentrically spaced sets of openings.

9. The consumable lance according to claim 6 wherein the longitudinal gas conveying conduits comprise tubes confined within concentrically spaced sets of openings provided within said spacer members to maintain a critical tube to tube spaced relationship "y".

10. The consumable lance according to claim 6 wherein the longitudinal gas conveying conduits include:

(a) a first concentric set of tubes spaced about the central longitudinal axis of the consumable lance said first set of tubes spaced along a tube circle and extending from a manifold chamber within the gas disbursing manifold of said upper lance portion through corresponding openings of a first set of concentrically spaced sets of openings within the spacer members of said structural support assembly and said tubes continuing thereon to the nozzle end of said lower lance portion, and, (b) a last concentric set of tubes spaced about the central longitudinal axis of the consumable lance said last set of tubes spaced along a tube circle and extending from the manifold chamber of said gas disbursing manifold through corresponding openings of a last set of concentrically spaced sets of openings within said spacer members said last set of concentrically spaced openings spaced along the periphery of said spacer members and said tubes continuing thereon to the nozzle end of said lower lance portion.

11. The consumable lance according to claim 6 wherein one or more gas conveying conduits are attached to a second gas source said second gas source conduits located outside the manifold chamber of said gas disbursing manifold and extending downward along the central core of said longitudinal structural support assembly to the nozzle end of the lower lance portion, said second gas source conduits being encased within the protective refractory covering.

* * * * *